US007367646B2

(12) United States Patent
Cordery et al.

(10) Patent No.: US 7,367,646 B2
(45) Date of Patent: May 6, 2008

(54) TEST CARD FOR INK JET PRINTERS AND METHOD OF USING SAME

(75) Inventors: Robert A. Cordery, Danbury, CT (US); Luis A. Sanchez, Hamden, CT (US); D. Austin Henderson, Easton, CT (US)

(73) Assignee: Pitney Bowes Inc., Stamford, CT (US)

( * ) Notice: Subject to any disclaimer, the term of this patent is extended or adjusted under 35 U.S.C. 154(b) by 448 days.

(21) Appl. No.: 11/020,876

(22) Filed: Dec. 22, 2004

(65) Prior Publication Data

US 2006/0132527 A1 Jun. 22, 2006

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,003,980 A * 12/1999 Sheinman et al. ..... 347/78
6,350,006 B1 2/2002 Muller et al.
6,629,747 B1 * 10/2003 King et al. ..... 347/19
6,644,773 B2 * 11/2003 Bildstein et al. ..... 347/19
6,669,324 B1 * 12/2003 King et al. ..... 347/19

* cited by examiner

*Primary Examiner*—Julian D. Huffman
(74) *Attorney, Agent, or Firm*—Brian A. Lemm; Angelo N. Chaclas

(57) ABSTRACT

A card for testing print heads includes a first layer having a first height and longitudinal length and a second layer located on top of the first layer having a second height and longitudinal length smaller than the first length. Also, a method of determining ink drop velocity including providing such a card, and printing a line including a plurality of dots thereon. A first of the dots is located on the first layer and a second of the dots is located on the second layer. Finally, the method includes determining a first relative distance between the first and second of the dots along the print direction, determining a second relative distance between the top surfaces of the first and second layers, and calculating the ink drop velocity as follows: V*(RD1/RD2), wherein V is the print velocity, D1 is the first relative distance, and D2 is the second relative distance.

7 Claims, 5 Drawing Sheets

TEST CARD FOR INK JET PRINTERS AND METHOD OF USING SAME

FIELD OF THE INVENTION

The present invention relates to the testing of ink jet printers, and, in particular, to a test card and method of using the test card for testing the operation of and evaluating the performance of an ink jet print head.

BACKGROUND OF THE INVENTION

Ink jet printers are well known in the art, and are utilized in many different printing applications. For example, the metering/printing modules of many current mailing machines utilize ink jet printing technology to print evidence of postage, such as postal indicia that include a 2-D barcode. Generally, an ink jet printer includes one or more arrays of nozzles (sometimes referred to as orifices), a supply of ink, a plurality of ejection elements (for example, expanding vapor bubble elements or piezoelectric transducer elements) corresponding to the nozzles and suitable driver and control electronics for controlling the ejection elements. Typically, the one or more arrays of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, an envelope or the like. Once they reach the print medium, the drops dry and collectively form a print image. In addition, it is known that when drops of ink travel along a flight path after being ejected, they typically break up into a main drop and one or more smaller drops known as satellites, all of which land on the print medium. Typically, the ejection elements are selectively activated (energized) or not activated (not energized) to expel or not expel, respectively, drops of ink as relative movement is provided between the print head and the print medium so that a predetermined or desired print image is achieved.

In order to improve the operation and performance, various types of testing and analyses are performed on the ink jet print head and the images printed by an ink jet print head. Two important characteristics related to the operation of an ink jet print head are drop velocity and satellite velocity, which are the velocities at which drops and satellites, respectively, travel after being ejected from a nozzle of an ink jet print head. By studying operating characteristics of an ink jet print head, such as drop velocity and satellite velocity, print quality and print head performance can be improved by, for example, designing inks, nozzles and/or firing pulses in a manner that minimizes the production of satellites, adjusting the voltage applied to a nozzle to eject an ink drop, and choosing a particular well performing ink. In addition, it is often necessary to test the performance of a particular ink jet print head to determine whether it meets the requirements of a particular printing application.

Conventional equipment for measuring drop velocity and satellite velocity includes complex optical and electronic equipment that is very expensive and difficult to calibrate. Examples of such equipment are the Drop Watcher testing machine manufactured by Imaging Technology International Corporation of Boulder, Colo., and the Genie testing machine manufactured by VisionJet, a subsidiary of Xennia Technology Limited of the United Kingdom. The Genie product is a sophisticated laser based droplet measurement system that captures precise, quantitative data on a series of individual droplets, through which a thorough understanding of the performance and reliability of the ink jet print head may be determined.

Because of the high cost and complexity of these types of equipment, they are impractical to use for many applications. Thus, there is a need for a simple and inexpensive method and apparatus for testing the operation and performance of an ink jet print head.

SUMMARY OF THE INVENTION

The present invention relates to a card for use in testing an ink jet print head such as by measuring characteristics like drop velocity. The card includes a first print medium layer having a first height and a first length along a longitudinal axis of the card and a second print medium layer located on a top surface of the first print medium layer. The second print medium layer has a second height and a second length along the longitudinal axis of the card. The first length is greater than the second length. In one embodiment of the card, the first height is equal to the second height, and in another embodiment of the card, the first height is different than the second height. The card may further include a third print medium layer located on a top surface of the first print medium layer. The third print medium layer has a third height and a third length along the longitudinal axis of the card, wherein the second length is greater than the third length. The second height may be equal to or different than the third height. In one particular embodiment, the first print medium layer is located on a top surface of a base layer, preferably made of a stiff material. The first, second and third print medium layers may be made of a photo quality ink jet printing paper material.

The present invention also relates to a card for use in testing an ink jet print head that includes a first print medium layer having a first height and a first length along a longitudinal axis of the card, and a plurality of second print medium layer pieces disposed and spaced along the first print medium layer, each of the second print medium layer pieces having a second height and a second length along the longitudinal axis of the card. The card may further include a plurality of third print medium layer pieces, wherein each of the third print medium layer pieces is located on a top surface of a respective one of the second print medium layer pieces. In this embodiment, each of the third print medium layer pieces has a third height and a third length along the longitudinal axis of the card, wherein the second length is greater than the third length. The second height may be equal to or different than the third height. The first print medium layer in this embodiment may also be located on a top surface of a base layer.

The present invention also relates to a method of determining a velocity of a drop of ink ejected by an ink jet print head having a plurality of nozzles. The method includes a step of providing a card having a first print medium layer having a first height and a first length along a longitudinal axis of the card, and a second print medium layer having a second height and a second length along the longitudinal axis of the card, wherein the first length is different than the second length. The method further includes printing a line on the card along the longitudinal axis during relative movement between the ink jet print head and the card in a print direction generally perpendicular to the longitudinal axis at a print velocity. The line includes a plurality of dots, each dot being produced by ink ejected from one of the nozzles of the ink jet print head. A first one of the dots is located on a top surface of the first print medium layer and a second one of the dots is located on a top surface of the second print medium layer, wherein the first one of the dots results from the drop of ink whose velocity is being measured. Finally, the method includes determining a first relative distance between the first one of the dots and the second one of the dots along the print direction, determining a second relative distance between the top surface of the first print medium layer and the top surface of the second print medium layer in a direction generally perpendicular to the print direction, and calculating the velocity of the drop of ink according to the following formula: V*(RD1/RD2), wherein V is the print velocity, RD1 is the first relative distance, and RD2 is the second relative distance. In one particular embodiment of the method, the second print medium layer is located above the first print medium layer and the first length is greater than the second length. More particularly, the second print medium layer may be located directly on top of the first print medium layer.

The present invention also relates to a method of adjusting the operating parameters of an ink jet print head, and a system that employs the method, wherein the method includes providing a test card as described herein, printing a test pattern on the card using the ink jet print head, calculating one or more print parameters (e.g., drop velocity or satellite velocity) using the test pattern on the card, determining one or more adjustment parameters using the one or more print parameters, and adjusting the operating parameters, such as nozzle voltage or the width, shape or timing of firing pulses, based on the adjustment parameters.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PREFERRED EMBODIMENTS

Figure 1:
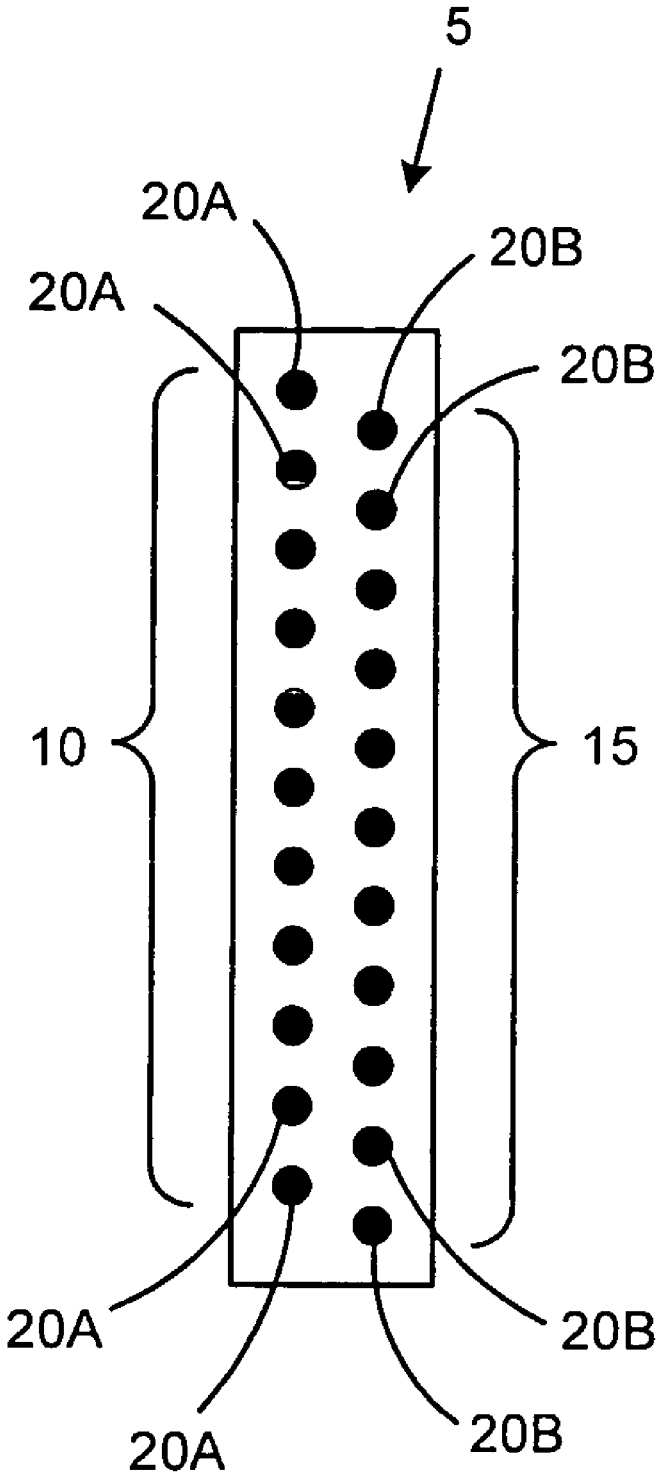
FIG. 1 is a schematic diagram of a typical inkjet print head.

A schematic diagram of an ink jet print head 5 is shown in FIG. 1. Ink jet print head 5 may be any type of ink jet print head (e.g., thermal (bubble) ink jet or piezoelectric ink jet). Ink jet print head 5 includes a first array 10 (commonly called the odd array) of vertically oriented nozzles 20A and a second array 15 (commonly called the even array) of vertically oriented nozzles 20B. Each nozzle 20A, 20B has a corresponding ejection element (not shown) for causing the ejection of a drop of ink. As seen in FIG. 1, nozzles 20A and 20B are offset from one another along the horizontal axis of ink jet print head 5 and alternate along the vertical axis of ink jet print head 5. As will be appreciated, the relative vertical spacing of the nozzles 20A and 20B determines the vertical printer resolution of ink jet print head 5. Ink jet print head 5 is designed such that first array 10 may be fired at a first time t1 and second array 15 may be fired at second time t2 as the print medium and ink jet print head S are moved relative to one another to produce a straight vertical line consisting of a plurality of dots, each dot corresponding to a drop of ink ejected by one of the nozzles 20A and 20B.

Figure 2:
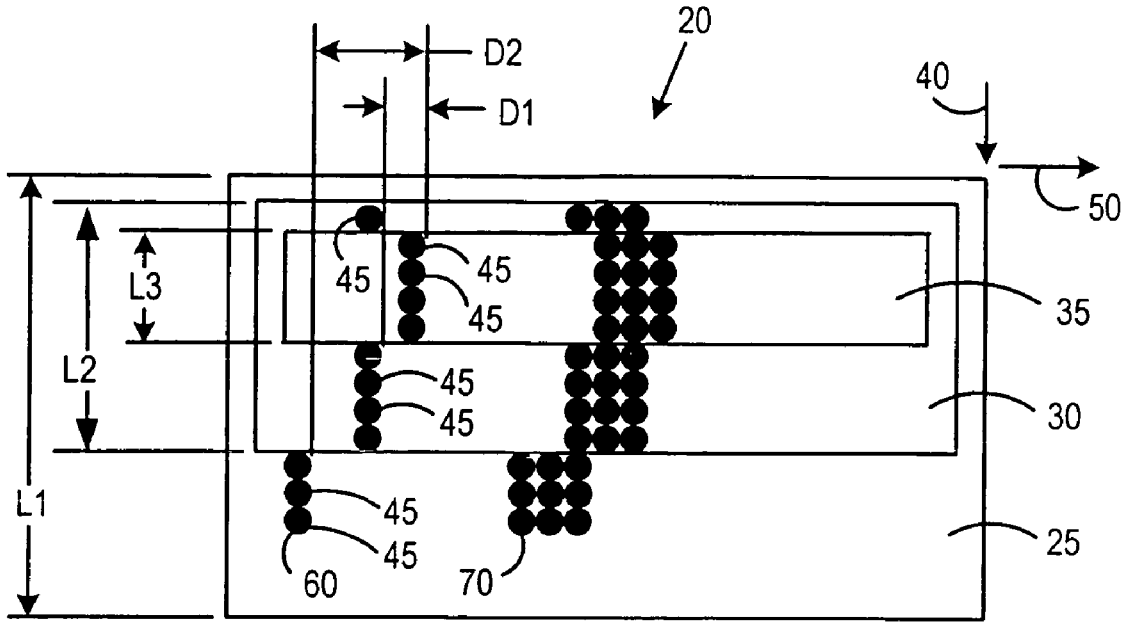
FIG. 2 is a top plan view of a test card according to an embodiment of the present invention.
Figure 3:
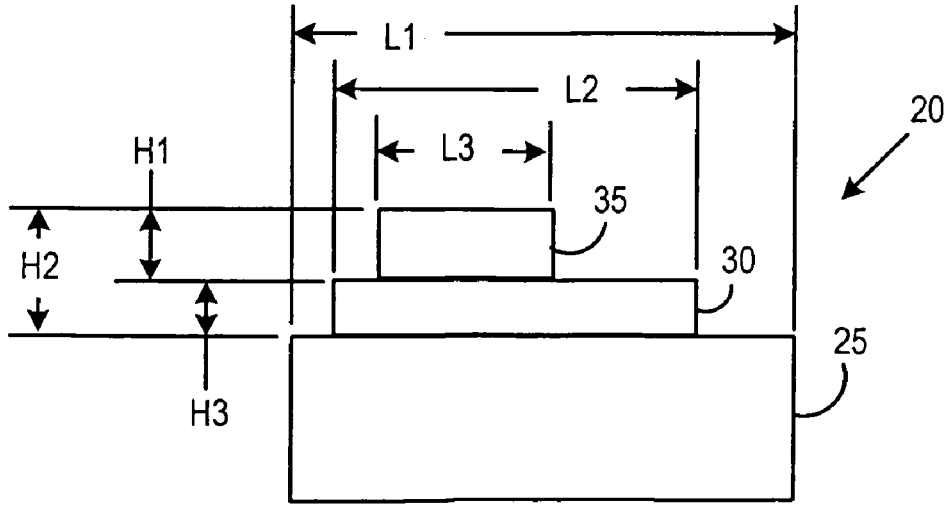
FIG. 3 is a side view of the test card shown in FIG. 2.

FIG. 2 is a top plan view and FIG. 3 is a side view of a test card 20 according to one embodiment of the present invention. As seen in FIGS. 2 and 3, test card 20 includes a plurality of individual layers adhered to one another. The embodiment shown in FIGS. 2 and 3 includes three layers, first layer 25, second layer 30 which is adhered to the top of first layer 25, and third layer 35 which is adhered to the top of second layer 30. In addition, first layer 25 has a length L1 that is greater than the length L2 of second layer 30, which in turn is greater than the length L3 of third layer 35, all lengths being measured along the axis of test card 20 (shown by arrow 40). This difference in lengths will enable dots to be printed by ink jet print head 5 on each of the layers 25, 30, 35 as described below. Referring to FIG. 3, third layer 35 has a height H1 relative to first layer 25 and H2 relative to second layer 30, and second layer 30 has a height H3 relative to first layer 25. H1 and H3 may be the same or different from one another (FIG. 3 shows H1≠H3).

Each layer 25, 30, 35 consists of a print medium (single layer or multiple stacked layers) capable of receiving and holding a drop of ink ejected from an ink jet print head such as ink jet print head 5. For example, layers 25, 30, 35 may be made of a photo quality or other ink jet paper. In addition, first layer 25 is preferably made of a stiff material, such as a stiff card material, capable of maintaining a generally flat planar surface for printing. Alternatively, first layer 25 may be a print medium such as photo quality or other ink jet paper adhered to such a stiff material, wherein the stiff material acts as a base layer for test card 20.

Figure 4:
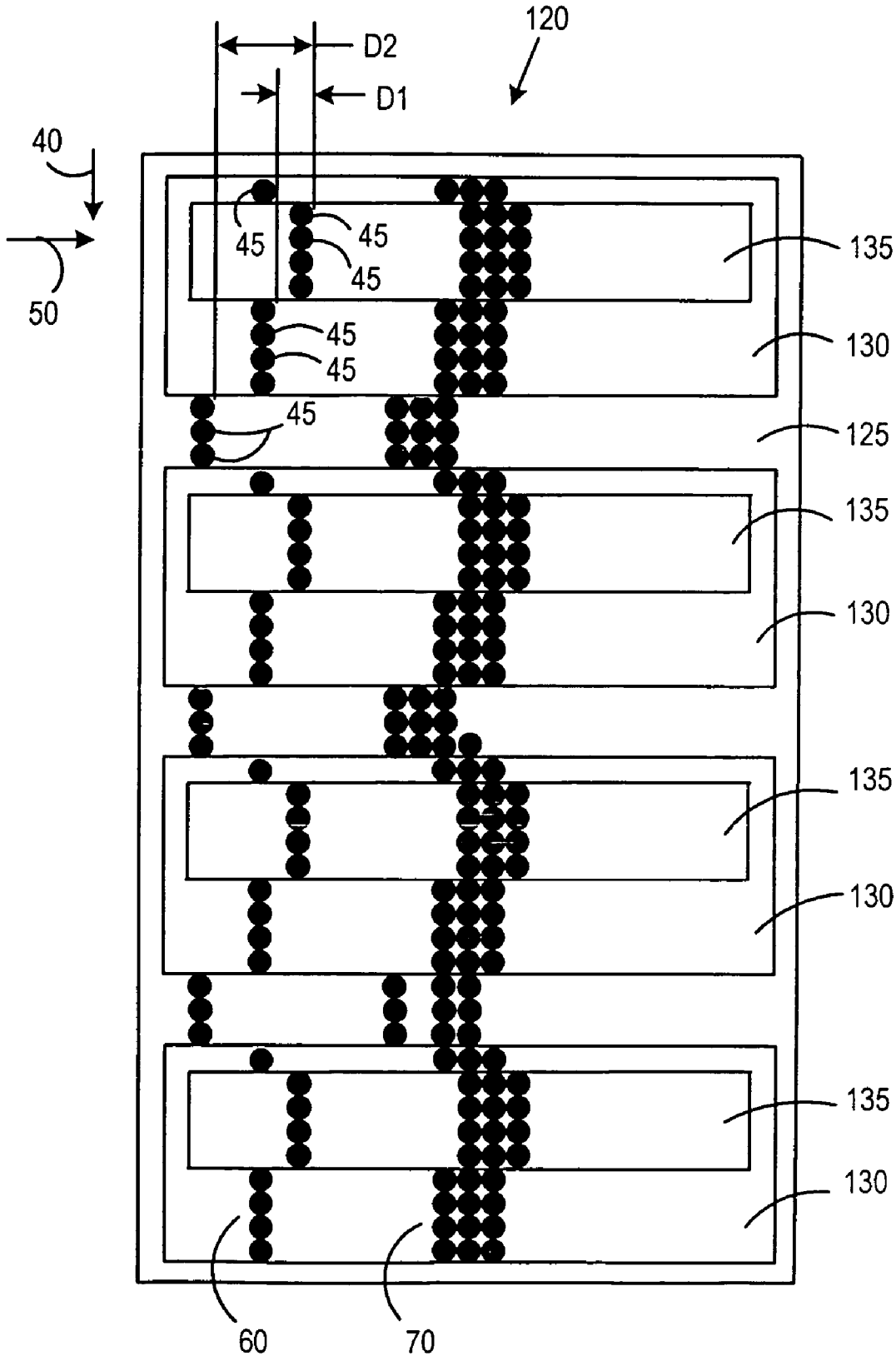
FIG. 4 is a top plan view of a test card according to another embodiment of the present invention.
Figure 5:
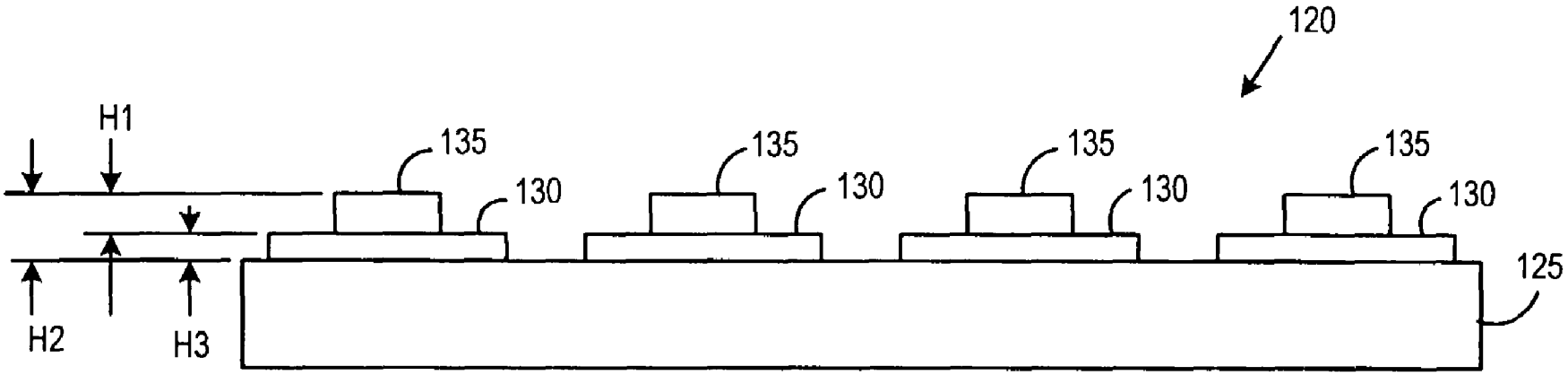
FIG. 5 is a side view of the test card shown in FIG. 4.

An alternative embodiment of test card 120 is shown in FIGS. 4 and 5. In the embodiment shown in FIGS. 4 and 5, test card 120 includes a plurality of second layer pieces (preferably having the same height) 130 (e.g., four) spaced along the longitudinal axis of test card 120, wherein each second layer piece 130 has the form of the second layer 30 shown in FIGS. 2 and 3. The test card 120 shown in FIGS. 4 and 5 also includes a plurality of third layer pieces (preferably having the same height) 135 (e.g., four) spaced along the longitudinal axis of test card 120, wherein each of the third layer pieces 135 is adhered on top of a respective one of the second layer pieces 130 and wherein each third layer piece 135 has the form of the third layer 35 shown in FIGS. 2 and 3. It should be appreciated that FIGS. 2, 3, 4 and 5 only represent first and second example embodiments of the present invention, and that other configurations consisting of just two layers (e.g., first layer 25 and second layer 30) or consisting of more than three layers are possible within the scope of the present invention.

In operation, ink jet print head 5 prints a vertical line test pattern 60 consisting of a plurality of dots 45 along the longitudinal axis of test card 20 (or test card 120) as relative movement is provided between ink jet print head 5 and test card 20, 120 at a known velocity $V_{print}$ in a direction (shown by arrow 50) that is generally perpendicular to the longitudinal axis of test card 20, 120 (such as by moving ink jet print head 5 relative to test card 20 or vice versa). Since the third layer 35, 135 is higher than the second layer 30, 130, which is higher than the first layer 25, 125, the dots along the vertical line will contact the third layer 35, 135 first, then the second layer 30, 130, and then the first layer 25, 125. Since the test card is moving at a velocity $V_{print}$, the dots 45 printed on third layer 35 (or pieces 135) will be located at a first position along the axis of test card 20, 120, respectively, that is generally perpendicular to the longitudinal axis of test card 20, 120, the dots 45 printed on second layer 30 (or pieces 130) will be located at a second position along that axis that is displaced from the first position by a distance D1, and the dots 45 printed on first layer 25, 125 will be located at a third position along that axis that is displaced from the first position by a distance D2. FIGS. 2 and 4 also show a test pattern that includes three successive vertical lines 70, followed by a space, and then another vertical line 60.

The velocity $V_i$ of any particular test pattern dot 45 (main dot or satellite) printed on one of the first layer 25 (or 125), the second layer 30 (or a second layer piece 130) or the third layer 35 (or a third layer piece 135) of a test card 20, 120 may be calculated according to the following formula:

$$V_i = V_{print} * (RD1/RD2)$$

wherein RD1 is the displacement along the axis that is generally perpendicular to the longitudinal axis of test card 20, 120 of the particular dot 45 relative to a position of another dot 45 of the same vertical line (the "reference dot") printed on a different layer (in other words, RD1 is the relative distance between the particular dot 45 and the reference dot in the same line), and RD2 is the relative distance between the two layers in question. Thus, referring to FIGS. 2 and 3, if a dot 45 on third layer 35 is used as the reference dot, then the velocity of a dot 45 in the same line on the second layer 30 would be equal to $V_{print}$*(D1/H1), and the velocity of a dot 45 in the same line on the first layer 25 would be equal to $V_{print}$*(D2/H2). As will be appreciated, dots 45 on other layers may be used as the reference dot. For example, if a dot 45 on second layer 35 is used as the reference dot, then the velocity of a dot 45 on the first layer 25 would be equal to $V_{print}$*(D2−D1/H3). The measurement of the relative displacements described herein may be facilitated through magnification, such as by using a microscope to view test card 20, 120 or a scanned image of test card 20, 120.

Figure 6:
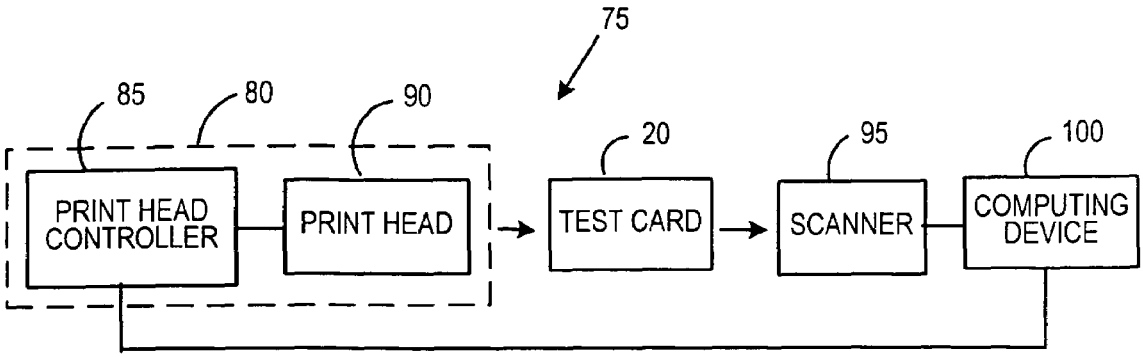
FIG. 6 is a block diagram of a system for automatically adjusting the operating parameters of a print head by using the test card of FIGS. 2-5 according to an aspect of the present invention.
Figure 7:
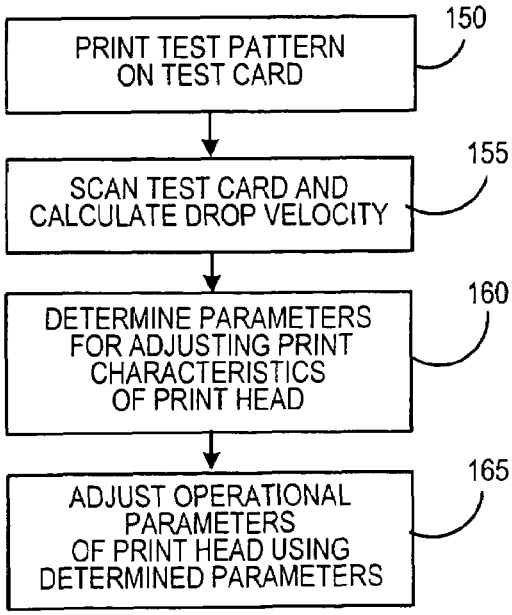
FIG. 7 is a flowchart illustrating the operation of the system of FIG. 6.

A further aspect of the invention relates to a system for automatically adjusting the operating parameters of a print head by using test card 20, 120. In particular, FIG. 6 is a block diagram of system 75 that includes ink jet printer 80 having a print head controller 85 and an ink jet print head 90. Print head controller 85 has a suitable processor and memory and is in operative communication with ink jet print head 90. System 75 further includes a scanner, having an appropriate resolution, such as, for example, at least five times the resolution at which the printing is performed, in electronic communication with computing device 100, such as a personal computer. FIG. 7 is a flowchart that illustrates the operation of system 75. At step 150, a test pattern, such as test pattern 60 or 70, is printed on test card 20 (or test card 120) using print head 90 in the manner described elsewhere herein. Next, at step 155, the test card 20, 120 including the test pattern 60 or 70 is scanned using scanner 95 to create an image (an electronic representation) thereof. The image data is sent to computing device 100, which is programmed with appropriate software for making measurements and calculations relating to the printing based on the dots 45 of the test pattern 60 or 70 such as is described herein. In particular, computing device 100 is, in the preferred embodiment, programmed to measure the dot distances described herein and calculate one or more drop velocities as described herein using the dimensional characteristics of the test card 20, 120. Then, at step 160, computing device 100 determines one or more operational parameters for adjusting the print characteristics of print head 90. Such operational parameters may, for example, and without limitation, relate to the voltages applied to the nozzles of print head 90, or the width, shape or timing of the firing pulses utilized in connection with print head 90. The determined operational parameters are then, at step 165, sent, preferably electronically, to print head controller 85. The actual operating parameters of print head 90 are then adjusted based on the determined operational parameters from step 160. Thus, in system 75, the test card 20, 120 is used to automatically adjust the operating parameters of print head 90 to optimize the performance of print head 90. It should be understood that several iterations of printing, scanning, determining and adjusting as illustrated in FIG. 7 may be necessary to optimize the operational parameters of the print head 90.

Thus, the present invention provides a simple and inexpensive solution for measuring characteristics associated with the printing performed by an ink jet print head with out the need to resort to expensive and complex optical and electronic equipment.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. For example, while the method of the present invention has been described in connection with a mail processing system such as a mailing machine, the method may also be implemented in any other device that uses an ink jet print head and transports print media past the ink jet print head for printing. Accordingly, the invention is not to be considered as limited by the foregoing description but is only limited by the scope of the appended claims.

What is claimed is:

1. A method of determining a velocity of a drop of ink ejected by an ink jet print head having a plurality of nozzles, comprising:

providing a card having a first print medium layer having a first height and a first length along a longitudinal axis of said card, and a second print medium layer having a second height and a second length along said longitudinal axis of said card, said first length being different than said second length;

printing a line on said card using said ink jet print head along said longitudinal axis during relative movement between said ink jet print head and said card in a print direction generally perpendicular to said longitudinal axis at a print velocity, said line comprising a plurality of dots, each dot being produced by ink ejected from one of said nozzles, a first one of said dots being located on a top surface of said first print medium layer and a second one of said dots being located on a top surface of said second print medium layer, said first one of said dots resulting from said drop of ink;

determining a first relative distance between said first one of said dots and said second one of said dots along said print direction;

determining a second relative distance between the top surface of said first print medium layer and the top surface of said second print medium layer in a direction generally perpendicular to said print direction; and calculating said velocity of said drop of ink ejected by said ink jet print head based on said print velocity, said first relative distance and said second relative distance.

2. A method according to claim 1, wherein said velocity of said drop of ink is calculated by the formula: V*(RD1/RD2), wherein V is said print velocity, RD1 is said first relative distance, and RD2 is said second relative distance.

3. A method according to claim 1, wherein said second print medium layer is located above said first print medium layer and said first length is greater than said second length.

4. A method according to claim 3, wherein second print medium layer is located directly on top of said first print medium layer.

5. A method of adjusting operating parameters of an ink jet print head, comprising:

providing a card having a first print medium layer having a first height and a first length along a longitudinal axis of said card, and a second print medium layer having a second height and a second length along said longitudinal axis of said card, said first length being different than said second length;

printing a test pattern on said card using said ink jet print head by printing a line on said card along said longitudinal axis during relative movement between said ink jet print head and said card in a print direction generally perpendicular to said longitudinal axis at a print velocity, said line comprising a plurality of dots, each dot being produced by ink ejected from one of a plurality of nozzles of said ink jet print head, a first one of said dots being located on a top surface of said first print medium layer and a second one of said dots being located on a top surface of said second print medium layer, said first one of said dots resulting from said drop of ink;

scanning said test card to read said test pattern;

based on said scanned test pattern, calculating drop velocity for an ink drop ejected by said ink jet print head by determining a first relative distance between said first one of said dots and said second one of said dots along said print direction, determining a second relative distance between the top surface of said first print medium layer and the top surface of said second print medium layer, and calculating said drop velocity of said ink drop ejected by said ink jet print head based on said print velocity, said first relative distance and said second relative distance;

determining one or more adjustment parameters using said calculated drop velocity; and adjusting said operating parameters based on said adjustment parameters.

6. A method according to claim 5, wherein said drop velocity of said ink drop is calculated by the formula: V*(RD1/RD2), wherein V is said print velocity, RD1 is said first relative distance, and RD2 is said second relative distance.

7. A method according to claim 5, wherein said second print medium layer is located above said first print medium layer and said first length is greater than said second length.

* * * * *